US011780712B2

(12) United States Patent
Boos

(10) Patent No.: US 11,780,712 B2
(45) Date of Patent: Oct. 10, 2023

(54) MOBILE CRANE HAVING A FOLDING BOOM ARRESTER DEVICE AND FOLDING BOOM FOR SAID CRANE

(71) Applicant: Liebherr-Werk Ehingen GmbH, Ehingen/Donau (DE)

(72) Inventor: Bernd Boos, Mehrstetten (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 109 days.

(21) Appl. No.: 17/369,872

(22) Filed: Jul. 7, 2021

(65) Prior Publication Data

US 2022/0009750 A1 Jan. 13, 2022

(30) Foreign Application Priority Data

Jul. 10, 2020 (DE) ..... 10 2020 118 261.9

(51) Int. Cl.
*B66C 23/42* (2006.01)
*B66C 23/82* (2006.01)

(52) U.S. Cl.
CPC ..... *B66C 23/42* (2013.01); *B66C 23/821* (2013.01)

(58) Field of Classification Search
CPC ..... B66C 23/42; B66C 23/68; B66C 23/702; B66C 23/821
See application file for complete search history.

(56) References Cited

U.S. PATENT DOCUMENTS

| | | | | |
|---|---|---|---|---|
| 3,785,505 | A * | 1/1974 | Keller, Jr. | B66C 23/702 212/177 |
| 3,830,376 | A * | 8/1974 | Fritsch | B66C 23/702 212/350 |
| 4,483,447 | A * | 11/1984 | Bernabe, Jr. | B66C 23/702 212/300 |
| 7,337,912 | B1 * | 3/2008 | Hull | B66C 23/42 212/300 |
| 10,647,552 | B1 * | 5/2020 | Jones | B66C 23/702 |
| 2011/0147331 | A1 * | 6/2011 | Tanaka | B66F 17/00 212/299 |

FOREIGN PATENT DOCUMENTS

EP 3369690 B1 1/2020

* cited by examiner

*Primary Examiner* — Michael R Mansen
*Assistant Examiner* — Juan J Campos, Jr.
(74) *Attorney, Agent, or Firm* — McCoy Russell LLP

(57) ABSTRACT

The present disclosure relates to a mobile crane that comprises an undercarriage having a chassis and comprises a superstructure that is rotatable about a vertical axis relative to the undercarriage and has a telescopic boom at whose tip a boom head is arranged. The boom has holding means at one side for the support of a folding boom that can be releasably installed at the boom head. The boom laterally has a console and a holding element arranged between the console and the boom head. The folding boom is pivotable about a vertical axis of the holding element for the installation at the boom head, while it is supported on the console. In accordance with the present disclosure, a first securing device is arranged in the region of the console by means of which a movement of the folding boom deviating from a pivot movement about a vertical axis can be limited. The present disclosure furthermore relates to a folding boom for a crane.

15 Claims, 6 Drawing Sheets

MOBILE CRANE HAVING A FOLDING BOOM ARRESTER DEVICE AND FOLDING BOOM FOR SAID CRANE

CROSS REFERENCE TO RELATED APPLICATIONS

The present application claims priority to German Patent Application No. 10 2020 118 261.9 filed on Jul. 10, 2020. The entire contents of the above-listed application is hereby incorporated by reference for all purposes.

TECHNICAL FIELD

The present disclosure relates to a mobile crane and to a folding boom for said crane.

BACKGROUND AND SUMMARY

Mobile cranes are typically adapted for driving on public roads. Special regulations with respect to the permitted weight and the maximum permitted dimensions (in particular height and width) of the mobile cranes apply in this sector. Different permissions are possible in dependence on their dimensions. The effort for applying for and obtaining exemptions also depends on the dimensions.

A mobile crane as a rule has a telescopic boom in addition to an undercarriage and a superstructure rotatably supported thereon. With some mobile cranes it is also customary for the crane use to install a fly boom, that is also called a folding boom, at the boom head or pulley head arranged at the end of the boom. Particularly with smaller mobile cranes, the folding boom is frequently supported at the side of the boom during trave in public road traffic. The mobile crane thus has greater variability in its utilizability. It is known for this purpose to support the folding jib laterally at the boom by means of a plurality of holding means, with a laterally projecting console being able to be provided on which the folding boom is supported during storage and/or during part of the installation procedure.

A major feature in mobile cranes having a folding boom supported at and taken along with the boom is the moving of the folding boom from a transport position at the boom into a working position in which it is installed at the boom head and vice versa (also called the assembly or disassembly of the crane). Such mobile cranes that can be traveled to the deployment site as a completely autonomous unit and that can be assembled there are also called taxi cranes.

The assembling of the folding boom in the working position requires various movements that can comprise both linear movements and movements about one or more typically vertical pivot axes. As a rule, however, crane actuators for these movements are only available to a limited extent. In this respect, it can be a drive already present at the crane such as a telescopic cylinder or a specifically attached drive such as a manually actuated hydraulic press.

The pivot movements of the folding boom during the assembly process have to be carried out in part at times at which no secure or complete connection to the telescopic boom has been established due to operating error. The folding boom, that is supported on the console, for example, via rolls/rollers, moves along the console during the pivot movement in this process. If operating errors occur here, the support of the folding boom could move to the end of the console, with the folding boom's own weight being able to result in a further unwanted movement and finally in a sliding of the folding boom from the console. In the worst case, a complete falling off of the folding boom is threatened.

Against this background, it is an underlying object of the present disclosure to further develop such a mobile crane such that the safety during assembly and disassembly is increased.

This object is achieved in accordance with the present disclosure by a crane that comprises an undercarriage having a chassis and a superstructure that is rotatable about a vertical axis relative to the undercarriage and has a telescopic boom at whose tip a boom head is arranged. The boom has holding means at one side for the support of a folding boom that can be releasably installed at the boom head. The boom laterally has a console and a holding element arranged between the console and the boom head. The fooling boom is pivotable about a vertical axis of the holding element for the installation at the boom head while it is supported on the console.

The forces caused by the folding boom's own weight during the movement procedures during the assembly or disassembly are distributed by the support on the console and the forces acting on the holding element are reduced. The chassis can be a crawler chassis or a wheeled chassis.

In accordance with the present disclosure, a first securing device is arranged in the region of the console by means of which a movement of the folding boom deviating from a pivot movement about a vertical axis can be limited.

The designation "vertical axis of the holding element" in the present case means that the connection between the folding boom and the boom formed by the holding element permits a pivot movement of the folding boom about a vertical axis. A movement of the folding boom deviating from a pivot movement about a vertical axis is a movement that not only takes place substantially in a horizontal plane, but that additionally also has a vertical movement component. This can in particular occur during an improper assembly procedure due to the folding boom's own weight on a sliding off or falling off of the folding boom.

In this respect, it is assumed in the present case that the assembly procedure of the folding boom takes place with a horizontally oriented boom so that the pivot axis about which the folding boom is pivoted is vertically oriented. However, the case is also covered by the present disclosure that the assembly/disassembly of the folding boom takes place with a slanted boom, i.e. a not completely horizontally oriented boom. In this case, the designations "vertical axis" and "horizontal plane" are to be understood such that the pivot movement of the folding boom takes place in a plane that is perpendicular to the pivot axis, with the pivot axis being oriented perpendicular to the longitudinal axis of the boom and being in a plane that is in parallel with the plane spanned by the longitudinal axis and the vertical.

A sliding of the folding boom from the console on an operating error can be prevented by the first securing device and the safety of the assembly and disassembly procedure can thereby be increased. The case is thus also covered by the safety system in accordance with the present disclosure that the folding boom is pivoted about the vertical axis of the holding element to join together fastening means of the folding boom and the boom head together, but a connection or pinning of the joined together fastening means is forgotten and the connection of the folding boom at the holding means is subsequently released. In this case, the folding boom is not held by the connection of the fastening means at the boom head and there is also the risk that the folding boom will slip off from the console and will fall off on a use of further holding or securing devices. A collapse of the folding boom is effectively prevented in such a case by the additional securing device in the region of the console.

Advantageous embodiments of the present disclosure result from the following description.

Provision is made in an embodiment that a second securing device by means of which a vertical movement or falling movement of the folding boom can be limited is arranged laterally at the boom between the first securing device and the boom head. A falling down of the folding boom can be reliably prevented even on a gross operating error by the combination of the first and second securing devices.

Provision is made in a further embodiment that the second securing device comprises a securing arm that projects from the boom and that is configured such that the folding boom does not come into contact with the securing arm in a transport position supported at the boom and on the pivoting about a vertical axis. In the transport position, the securing arm can either be arranged beneath the folding boom or can project between the corner bars and connection struts of the folding boom without the folding boom being contacted. On a collapse of the folding boom, it falls onto the securing arm so that the falling movement is stopped. The securing arm can furthermore have an upwardly projecting nose at its end spaced apart from the boom that prevents a lateral sliding down of the folding boom. A horizontal movement of the folding boom can therefore be blocked by the nose.

The second securing device alone admittedly already reduces the risk of a collapse of the folding boom on an operating error, but does not cover all the conceivable scenarios of incorrect movements of the folding boom during the assembly and disassembly procedure. There is thus the risk, for example, in the above-described scenario, in which a connection of the joined together fastening means is forgotten and the connection at the holding element is subsequently released, that the folding boom slides off the second securing device and from the console despite the capturing effect of said second securing device. This can only be effectively prevented by the first securing device in accordance with the present disclosure that is arranged in the rear region of the boom.

Provision is made in a further embodiment that the first securing device is arranged at the console. The first securing device is therefore connected to the console or to a part of the console.

Provision is made in a further embodiment that the console has a foldable structure and comprises at least two console parts that are pivotably connected to one another and are releasably latchable, with the console being movable into an assembly position for the assembly of the folding boom at the boom head by unfolding from a transport position and vice versa on the disassembly. On a pivoting of the folding boom about the holding element, the folding boom covers relatively long distances on the console due to the lever relationships so that said console has to be formed as comparatively long during the assembly. The foldable design of the console enables a space-saving travel of the crane and a support of the folding boom since it is only supported at a part of the console close to the boom in the transport position. The console can be built up from two, three or an even larger number of parts that are respectively pivotably connected to one another and are releasably latchable.

Provision is made in a further embodiment that the console is configured such that the folding boom is supported in a transport position supported at the boom via at least one roller on a first console part preferably fixedly connected to the boom and such that the folding boom rolls off over the at least one roller along the upper side of the console on a pivot movement about the vertical axis of the holding element and with a console unfolded into the assembly position.

Provision is made in a further embodiment that the first securing device is arranged at a pivotable part of the console that forms the end piece of the console in the assembly position and is configured such that the folding boom does not come into contact with it in a transport position supported at the boom and on the pivoting about a vertical axis. If therefore a proper assembly procedure takes place in which the folding boom performs a pivot movement about a vertical axis, i.e. a movement within a substantially horizontal plane, it does not contact the first securing device. A contacting of the first securing device such that a falling off is prevented only takes place in the case of an additional vertical movement component, in particular when the folding boom is about to slide off from the console.

The upper side of the console facing the folding boom is preferably chamfered toward the bottom in the region of the first securing device. This can be necessary, for example, since the outer parts of the console have to be pivotable, while the folding boom is supported in the transport position on an inner or first part of the console that is in particular not movable. If the folding boom is not held on a pure orbit of movement taking place about a vertical axis by a proper fastening, the support, e.g. a roller/roll, can move onto this inclined section and can produce an acceleration and sliding off of the folding boom. The first securing device can advantageously be attached such that a rolling down of the folding boom along this chamfered surface is allowed for, i.e. a contact of the first securing device by the folding boom only takes place specifically in this case.

Provision is made in a further embodiment that the first securing device comprises an arrester element that is in particular rod-shaped or bar-shaped and that is configured such that on a movement differing from a pivot movement about a vertical axis or on a sliding of the folding boom from the console, an arrester hook provided at the folding boom comes into engagement with the arrester element and blocks a further movement of the folding boom. The arrester hook is preferably configured such that a release of the connection with the arrester element is precluded. The arrester hook is furthermore arranged such that no contact of the arrester element takes place on a proper setup procedure. The arrester hook can be welded or fastened in another manner, e.g. by screws, clamps, or the like, to the folding boom, in particular to a corner bar or to a connection strut.

Provision is made in a further embodiment that the arrester element projects from the console at both sides, with two arrester hooks being provided at the folding boom that are arranged such that they come into engagement with the arrester element on both sides of the console on a sliding of the folding boom from the console. Such a symmetrical solution is more stable and can where necessary compensate a tilt position of the folding boom on the sliding from the console so that at least one of the two arrester hooks comes into engagement with the corresponding arrester element in every case. The arrester element can here be produced in one part, for example as a single bar element projecting at both sides over the console, or in multiple parts, e.g. as two separate rod elements attached to both sides of the console.

The reverse case is provided in an alternative embodiment, namely that the first securing device comprises at least one arrester element that is configured such that on a movement differing from a pivot movement about a vertical axis or on a sliding of the folding boom from the console, an arrester element arranged at the folding boom and in particular of rod shape comes into engagement with the arrester hook and blocks a further movement of the folding boom. A plurality of arrester hooks can also be provided here, e.g. in a symmetrical arrangement with respect to the console.

Provision is made in a further embodiment that the arrester element is formed by a corner bar or by a connection strut of the folding boom. The folding boom thereby does not have to be equipped with an additional component, which saves costs and weight.

A combination of the two aforesaid embodiments is also conceivable so that the first securing device has both an arrester element and an arrester hook that cooperate with a corresponding arrester hook and a corresponding arrester element of the folding boom or that come into engagement on a sliding of the folding boom from the console.

Provision is made in a further embodiment that the boom head has fastening means for a connection with corresponding fastening means of the folding boom, with at least one fastening means of the folding boom being able to be joined together with a fastening means of the boom head by pivoting the folding boom about the vertical axis of the holding element, with the folding boom preferably being pivotable about a vertical axis of the joined together and connected fastening means after connecting the joined together fastening means and the release of the connection to the holding element and with the remaining fastening means thereby being able to be joined together. The fastening means can be pinning points or fork elements that are reversibly connectable to one another by pinning. The pin connections here each form a vertical axis about which the folding boom is pivotable.

The present disclosure furthermore relates to a folding boom for a crane. In this respect, the same advantages and properties result for the crane in accordance with the disclosure so that a repeat description will be dispensed with at this point. The above statements with respect to the possible embodiments of the folding boom with regard to the crane in accordance with the disclosure therefore apply accordingly to the folding boom.

The folding boom in accordance with the present disclosure can in particular have at least one roller/roll via which it is seated on the console and rolls off on the console during the pivoting about the vertical axis of the holding element, as described above. The folding boom furthermore preferably has, as described above, an arrester hook or an arrester element that, on a sliding of the folding boom from the console differing from a pivot movement about a vertical axis comes into engagement with a corresponding arrester element or arrester hook in the region of the console such that a further movement of the folding boom is blocked. The folding boom can furthermore have a plurality of mutually tiltable or pivotable parts so that a front part of the installed folding boom can be inclined—e.g. by means of an adjustment cylinder.

The present disclosure furthermore relates to a crane in combination with a previously described folding boom.

BRIEF DESCRIPTION OF THE FIGURES

Further features, details, and advantages of the present disclosure result from the embodiments explained in the following with reference to the Figures. There are shown.

DETAILED DESCRIPTION

Figure 1:
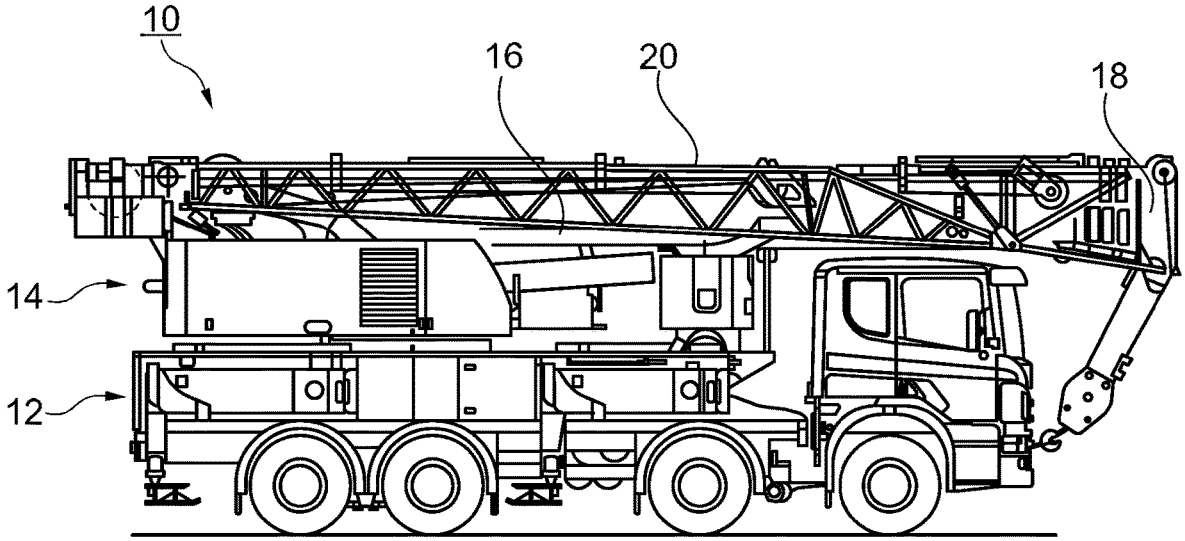
FIG. 1: an embodiment of the crane in accordance with the present disclosure with a folding boom in the transport position in a side view.
Figure 2:
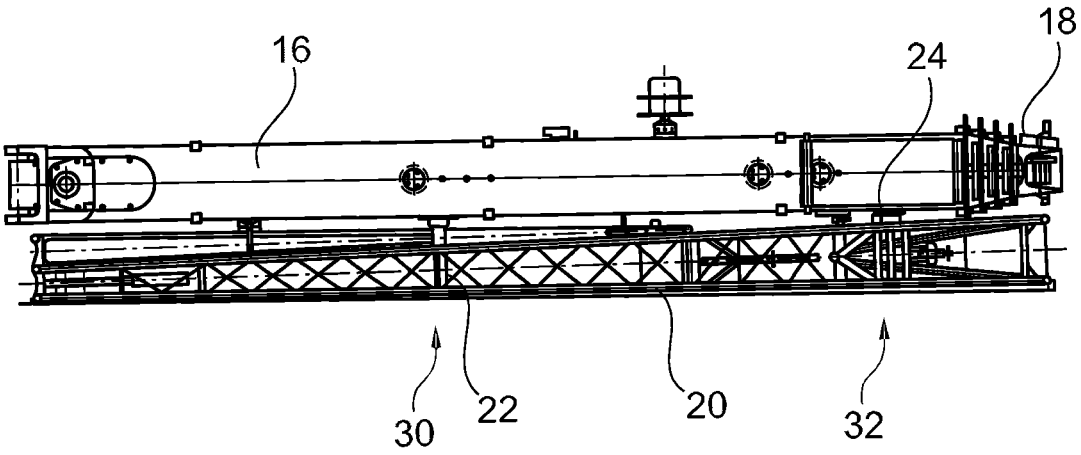
FIG. 2: a plan view of a boom and folding boom of the crane in accordance with FIG. 1.
Figure 3:
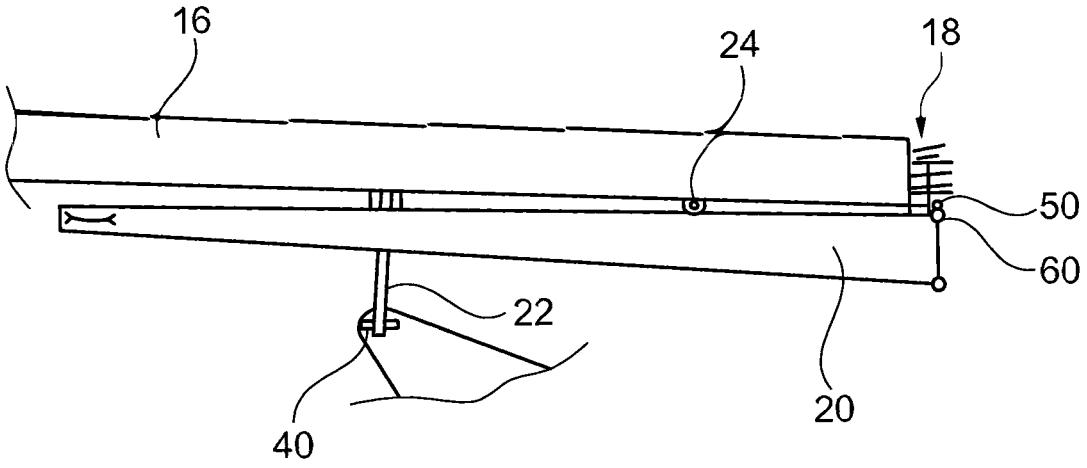
FIG. 3: a schematic representation of the view in accordance with FIG. 2.

An embodiment of the mobile crane 10 in accordance with the present disclosure is shown in a side view in FIG. 1. The crane 10 has an undercarriage 12 having a four-axle wheeled chassis, a superstructure 14 supported on the undercarriage 12 rotatably about a vertical axis, and a telescopic boom 16 arranged on the superstructure 14 pivotably about a horizontal axis. A roller head or boom head 18 that has a plurality of fastening means 50 that are formed as pinning points and via which a folding boom 20 can be installed at the boom as required is located at the end of the boom 16. FIGS. 2 and 3 show the boom 16 and the folding boom 20 in each case in a plan view (FIG. 3 in a schematic view).

The present embodiment is a so-called taxi crane 10 since the folding boom 20 can be traveled to the deployment site with the crane 10 and can be assembled and disassembled on site without any further external auxiliary means. The folding boom 20 can be supported and secured laterally at the boom 16 in a transport position (as shown in FIG. 1) for this purpose. The boom 16 has a row of holding means laterally for this purpose. For assembly at the boom head 18, the folding boom 20 likewise has a plurality of fastening means 60 formed as pinning points. In this respect, the folding boom 20 is supported in the transport position such that the wider end having the fastening means 60 is positioned next to the boom head 18.

The boom 16 has a holding element 24 laterally via which the folding boom 20 is supported at the boom 16 pivotably about a vertical axis, with the folding boom 20 being secured against an unwanted pivoting in the transport position via additional holding means not shown in any more detail here. A console 22, on which the folding boom 20 is supported via a plurality of rolls or rollers 26, is furthermore laterally arranged further to the rear on the boom 16 (in the direction of the support at the superstructure 14). In the region of the holding element 24, there is a securing arm 34 having a nose 36 that is arranged at the end spaced apart from the boom 16, that projects upwardly, and that is arranged and configured such that it does not come into contact with the folding boom 20 in the transport position and on a proper assembly and disassembly.

Figure 4:
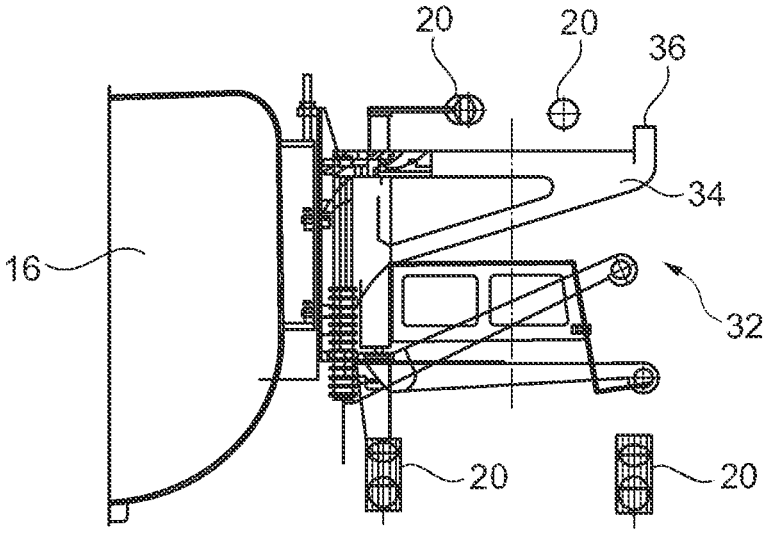
FIG. 4: a schematic cross-sectional view perpendicular to the longitudinal axis through the folding boom and the boom in the region of the second securing device.
Figure 5:
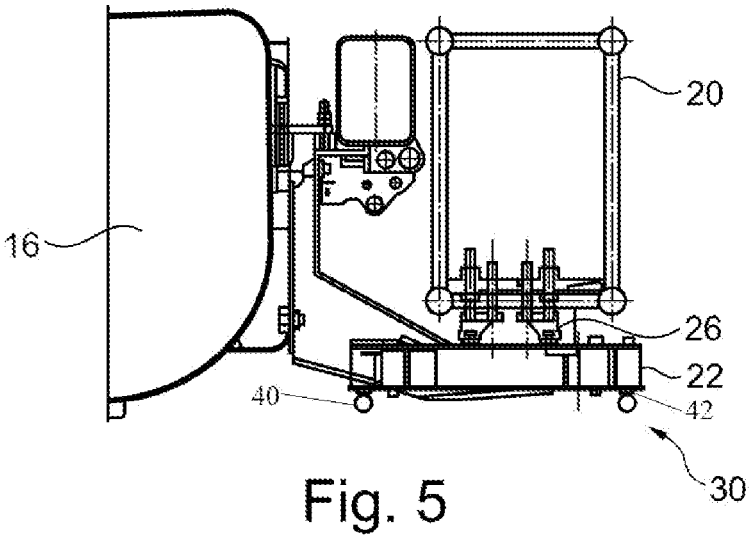
FIG. 5: a schematic cross-sectional view perpendicular to the longitudinal axis through the folding boom and the boom in the region of the first securing device.
Figure 6:
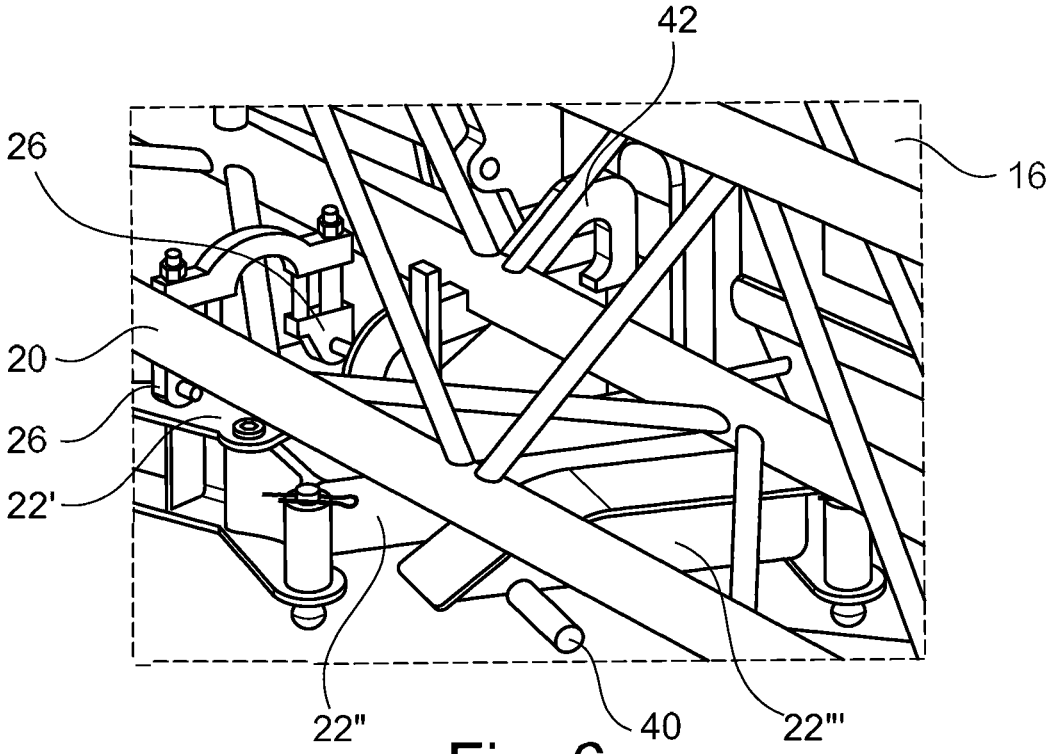
FIG. 6: a detail of the folding boom supported at the boom looking toward the console in the transport position in a perspective representation.
Figure 7:
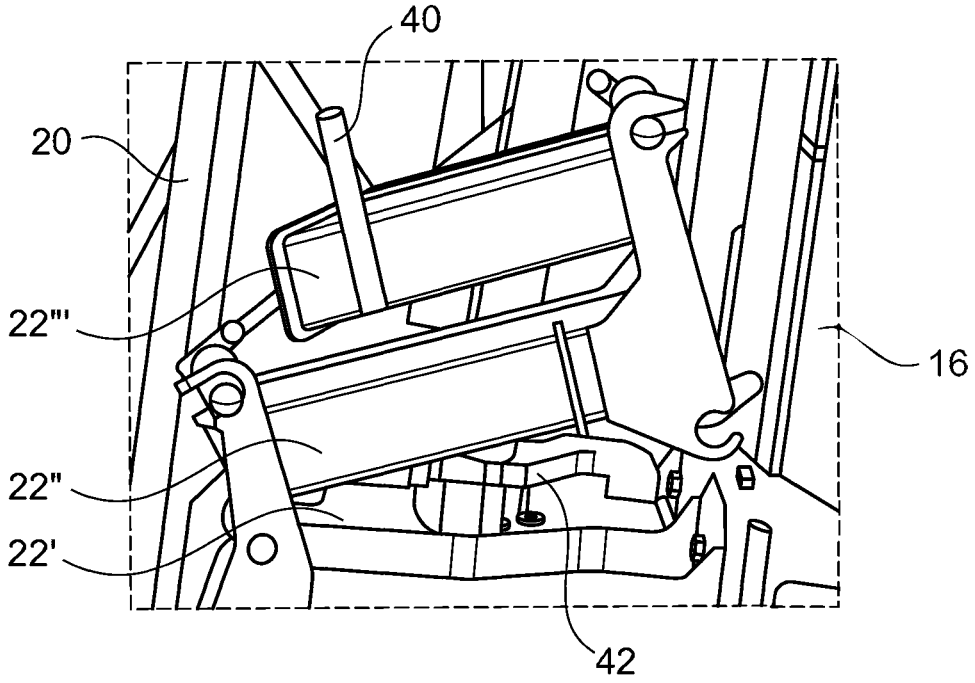
FIG. 7: the console in accordance with FIG. 6 with a view of its lower side.

FIGS. 4 and 5 show schematic cross-sectional views of the folding boom 20 and of a part of the boom 16 perpendicular to the longitudinal axis of the folding boom 20 or of the boom 16 in the region of the securing arm 34 (FIG. 4) and of the console 22 (FIG. 5). The boom 16 is drawn schematically here. As can be recognized in FIG. 4, the securing arm 34 is arranged at a level at which is projects below and through the upper corner bars and above and through the lower corner bars of the folding boom 20. No contact therefore takes place on a lateral pivot movement of the folding boom. The securing arm 34 serves as an arrester device that is intended to prevent a falling off of the folding boom 20 on an operating error. If the folding boom 20 falls from the boom 16, it is intercepted by the securing arm 34, with the nose 35 preventing the folding boom 20 from sliding off laterally over the securing arm 34.

On the assembly of the folding boom 20, a pivoting (for example by means of a hydraulic cylinder) first takes place about the vertical axis formed by the holding element 34 to join together the fastening means 50, 60 of the boom head 18 and the folding boom 20 in a horizontal orbit of movement and to bring them to cover one another. They are subsequently pinned so that from this point in time onward the folding boom 20 is securely fastened to the boom 16 and a falling off of the folding boom 20 is no longer possible. The connection at the holding element 24 can now be released. In the next step, a horizontal pivot movement of the folding boom 20 takes place about the vertical axis formed by the pin connection of the fastening means 50, 60 until the longitudinal axes of the folding boom 20 and of the boom 16 are aligned and are thus disposed in the same planes or in parallel planes and the remaining fastening means 50, 60 are joined together. Finally, the latter are likewise pinned. On dismantling, the reverse order of the aforesaid steps takes place.

During the pivot movement of the folding boom 20 about the holding element 24, the outer end of the folding boom 20 (the left end in FIG. 2) moves away from the boom 16. It is guided on the console 22 in this process. The rollers 26 are provided to reduce the forces. The required region in which the folding boom 20 is supported on its pivot movement is relatively long due to the lever ratios. For this reason, the console 22 is foldable and comprises three console parts 22', 22", 22'" that are each pivotably connected and latchable to one another.

In the transport position of the folding boom 20, the console 22 is folded inward in a transport position to reduce the space requirement of the boom 16. The folding boom 20 is here supported on the first console part 22' that is directly fastened to the boom 16. On the assembly of the folding boom 20, the console 22 is unfolded, in contrast, so that the console parts 22', 22", 22" are linearly aligned and latched. The folding boom 20 can thereby roll off over the rollers 26 on the surface of the unfolded console 22 on the lateral pivoting. The console 22 is shown schematically in the unfolded state (assembly position) in FIG. 3.

While the securing arm 34 already provides a certain protection against a collapse of the folding boom 20 as a consequence of improper operation, serious operating errors are in particular not always sufficiently covered. A situation in which a pinning of the fastening means 50, 60 joined together after a pivoting about the holding means 24 is forgotten and the connection at the holding means 24 is subsequently released can thus, for example, have the result that the folding boom 20 falls onto the securing arm 34 and then slides off the console 22. It may occur on such a movement that the folding boom 20 slides over the nose 36 and subsequently falls down due to the sloped position of the folding boom 20 that is caused by its own weight and by the two support points 22, 24.

In order also to cover the situations in which the folding boom 20 slides off to the rear and to ensure a safe setup procedure even with serious operating errors, a further arrester device or securing device 30 is provided in accordance with the present disclosure in the region of the console 22. This device in accordance with the present disclosure arranged in the rear region of the boom 16 will be called a first securing device 30 in the following and the secure arm 34, together with the nose 36, arranged in the front region of the boom 16 will be called a second securing device 32.

A first embodiment of the first securing device 30 in accordance with the present disclosure is shown in more detail in FIGS. 6-9. The console 22 is here shown in FIGS. 6 and 7 in the inwardly folded state or in the transport position in which the two pivotable console parts 22", 22'" contact the first console part 22'. The folding boom 20 is located at the boom 16 in the transport position and is supported on the first console part 22' via the rollers 26. The outermost console part 22'" is chamfered in a sloping or downward manner toward the end. This is inter alia due to the fact that the outer console parts 22", 22'" have to be freely pivotable while the rollers 26 of the folding boom 20 are supported on the first console part 22'. The slope of the console in its tapering region is actually due to the disassembly procedure. On the disassembly, the operator pivots the folding boom toward the side of the boom 16. The folding boom is only held at two pins about the pivot axis here. A large lever arm that deflects the folding boom downwardly is produced by the large outreach. The folding boom thus has to have support in the end phase of the pivot movement via the rollers 26 and thereby has to be raised in its transport position at the boom.

Figure 8:
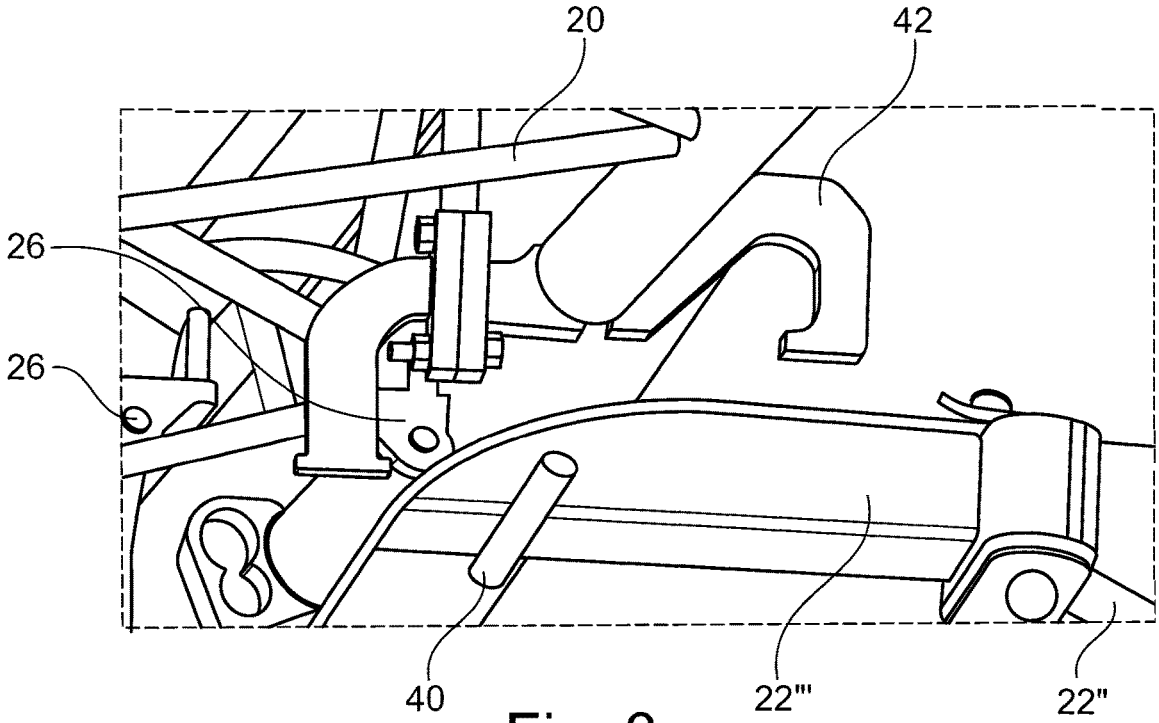
FIG. 8: a detail of the folding boom rolling off on the unfolded console in a perspective view
Figure 9:
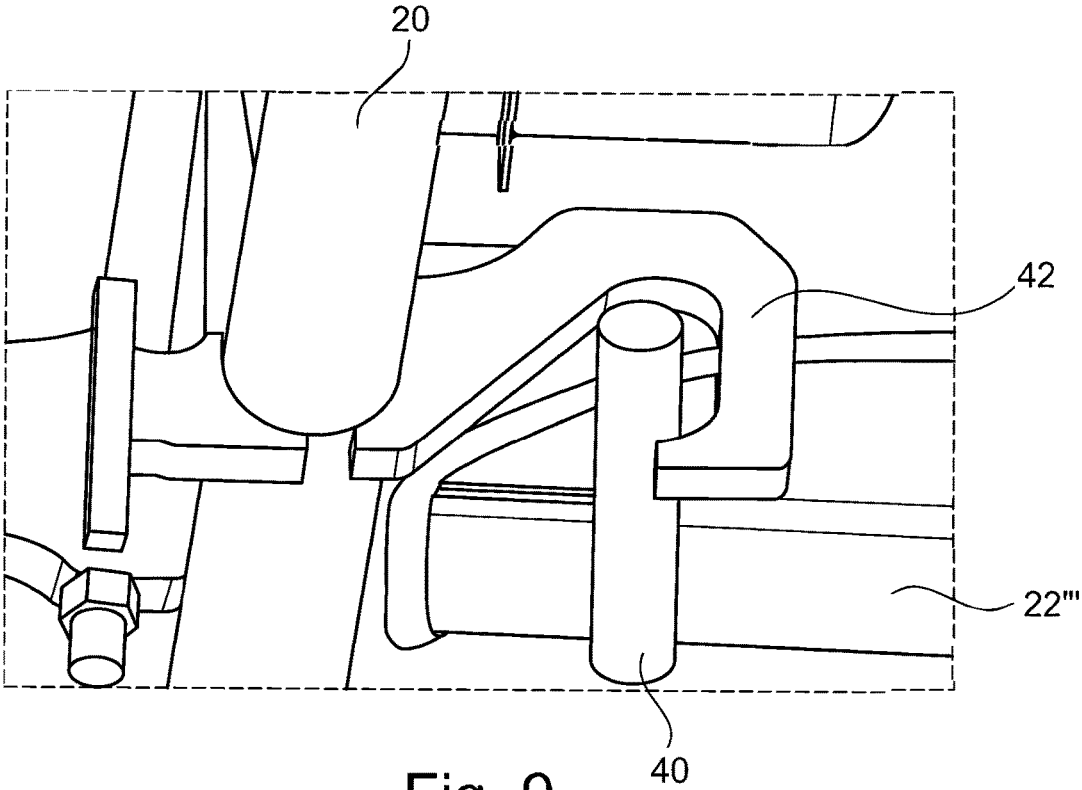
FIG. 9: a detail of the arrester hook engaging around the arrester element after the siding of the folding boom off from the console in a perspective view.

A thrust bearing in the form of a rod-shaped arrester element 40 is arranged at the outermost console part 22'" and projects laterally (perpendicular to the longitudinal axis of the console part 22'" in the present embodiment) from the console part 22'". FIG. 8 shows the outermost console part 22'" in the unfolded state, i.e. the console 22 is in the assembly position. On the outward pivoting of the folding boom 20, the rollers 26 roll off on the unfolded console 22. On a proper assembly procedure, the folding boom 20 moves in a horizontal plane on the pivoting about a vertical axis (of the holding element 24 or of the pinning of the fastening means 50, 60). If an operating error occurs in which the folding boom 20 slides off to the bottom, i.e. in which the movement of the folding boom 20 has a vertical component, the first securing device 30 thus provides that this unwanted movement is stopped or blocked.

Figure 10:
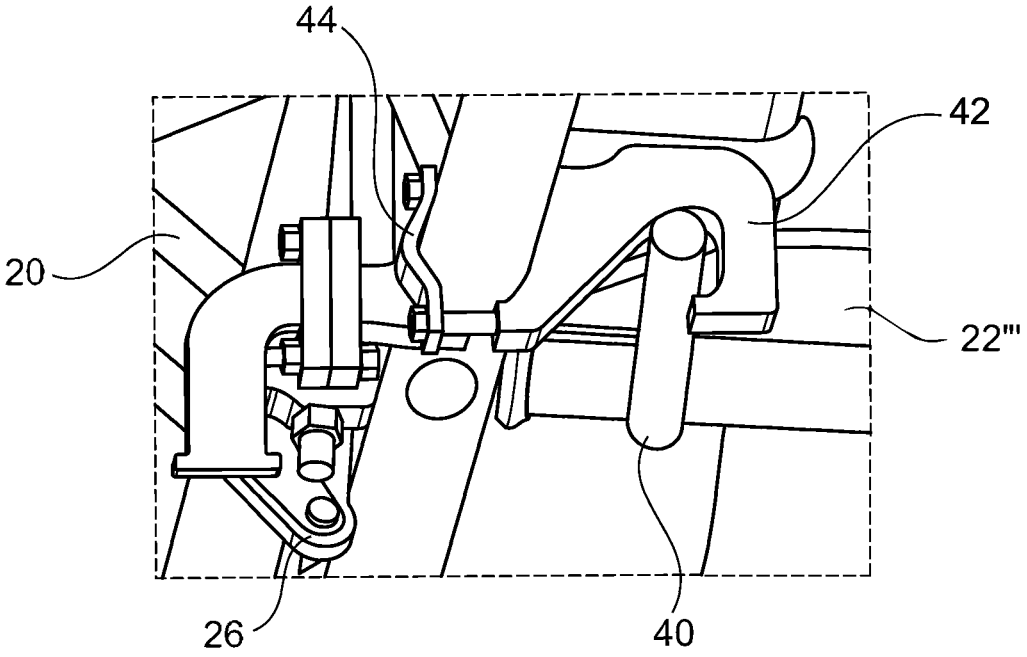
FIG. 10: the situation in accordance with FIG. 9 with an arrester hook in accordance with a further embodiment.

For this purpose, an arrester element in the form of a hook or of an arrester hook 42 is provided at the folding boom 20 and is welded in the embodiment shown in FIGS. 6-9 to a corner bar of the folding boom 20 in which in the embodiment shown in FIG. 10, in contrast, is clamped to the corner bar by means of a clamp 44. If the rollers 26 of the folding boom 20 leave the console 22, as can be seen in FIG. 8, the folding boom 20 rolls down the inclined surface of the outermost console part 22'" and accelerates due to gravity. After leaving the console 22, the support effect is completely lost. The previous movement of the folding boom 20, however, is maintained so that a combined movement results with vertical and horizontal components. The locations of the arrester hook 42 and of the arrester element 40 are therefore selected suitably so that the arrester hook 42 of the folding boom 20 just falling down engages around the arrester element 40 and the folding boom 20 is thereby "intercepted" (cf. FIGS. 9-10). On a proper assembly procedure or disassembly procedure, the arrester element 40 is, however, not contacted by the arrester hook 42.

The shape/contour of the arrester hook 42 is designed such that a release of the connection to the arrester element 40 is not possible on its own. The connection between the arrester element 40 and the arrester hook 42 can optionally be configured such that energy can be reduced. This could take place by plastic deformation of the arrester element 40 and/or arrester hook 42 or also via friction. A certain elasticity of the components would also be conceivable.

In contrast to the representation shown, a symmetrical solution is also conceivable. A longer arrester element 40 projecting at both sides of the outer console part 22''' and two or more arrester hooks 42 at both sides of the console 22 could thus be used. An arrester hook 40 formed even longer on one side and the use of a plurality of arrester hooks 42 on one side of the console 22 would also be conceivable. Different positions/inclinations of the folding boom 20 on a falling down could thereby be taken into account and a safe interception could be ensured.

Figure 11:
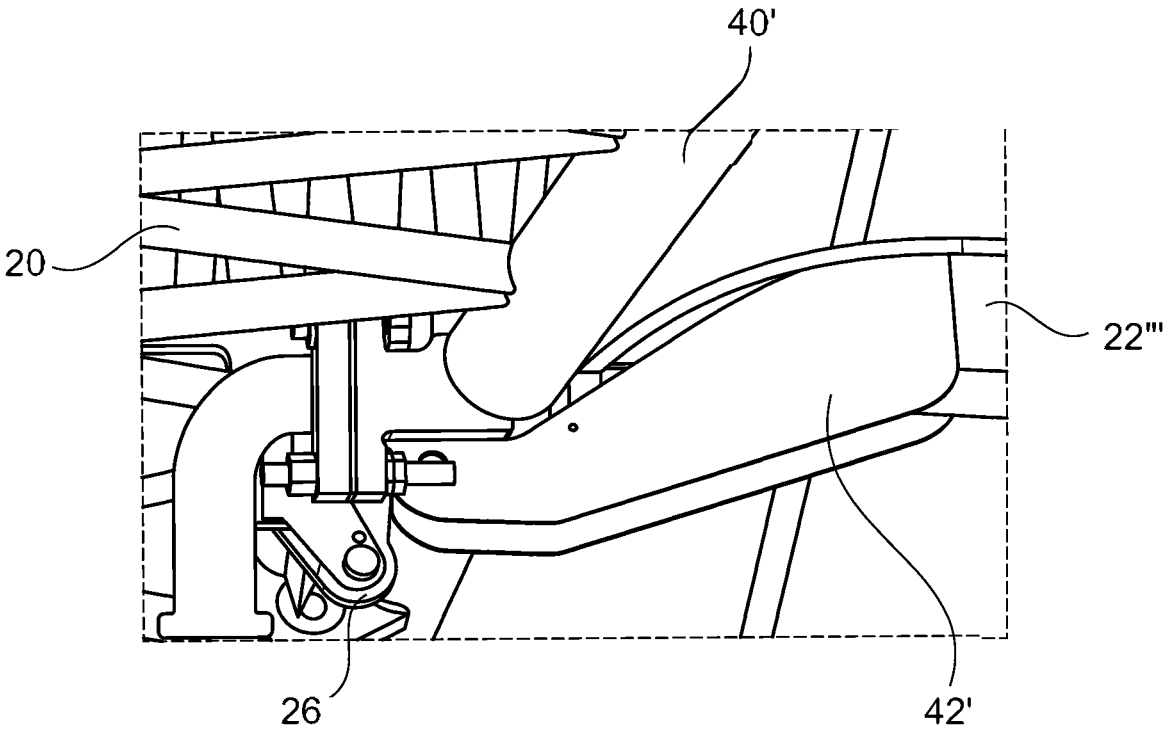
FIG. 11: a detail of the arrester hook and the arrester element after the sliding of the folding boom from the console in accordance with an alternative embodiment in a perspective view.

FIG. 11 shows an alternative embodiment in which an arrester hook 42' formed from two parallel metal sheets is provided at the end of the console 22 or as an extension of the outermost console part 22''' and the arrester element 40' is arranged at the folding boom 20. It can be implemented, for example, in that—as shown in FIG. 11—one of the corner bars of the folding boom 20 forms the arrester element 40' and is intercepted and held on the falling down from the arrester hook 42'. A separate arrester element 40' can naturally also be provided at the folding boom 20. The location and shape of the arrester hook 42' can also differ from the embodiment shown in FIG. 11.

FIGS. 1-11 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

REFERENCE NUMERAL LIST

10 mobile crane
12 undercarriage
14 superstructure
16 boom
18 boom head
20 folding boom
22 console
22' console part
22'' console part
22''' console part
24 holding element
26 roller
30 first securing device
32 second securing device
34 securing arm
36 nose
40 arrester element
40' arrester element (corner bar)
42 arrester hook
42' arrester hook
44 clamp
50 fastening means boom head
60 fastening means folding boom

The invention claimed is:

1. A mobile crane comprising an undercarriage having a chassis and comprising a superstructure rotatable about a vertical axis relative to the undercarriage and having a telescopic boom at whose tip a boom head is arranged, wherein the telescopic boom has a holding element at one side for supporting a folding boom that can be releasably assembled at the boom head, wherein the telescopic boom laterally has a console and the holding element is arranged between the console and the boom head, and wherein the folding boom is pivotable about a vertical axis of the holding element at the boom head, while the folding boom is supported on the console, wherein a first securing device is arranged in a region of the console by means of which a movement of the folding boom deviating from a pivot movement about a vertical axis can be limited;

a second securing device by means of which a vertical movement of the folding boom can be limited is arranged laterally at the telescopic boom between the first securing device and the boom head; and the second securing device comprises a securing arm that projects from the telescopic boom and that is configured such that the folding boom does not come into contact with the securing arm in a transport position supported at the telescopic boom and on pivoting about a vertical axis, with the securing arm.

2. The crane in accordance with claim 1, wherein the first securing device is arranged at the console.

3. The crane in accordance with claim 1, wherein the console has a foldable structure and comprises at least two console parts that are pivotably connected to one another and are releasably latchable, with the console being movable into an assembly position for assembly of the folding boom at the boom head by unfolding from the transport position and vice versa.

4. The crane in accordance with claim 3, wherein the console is configured such that the folding boom is supported in the transport position supported at the telescopic boom via at least one roller on a first console part and such that the folding boom rolls off over the at least one roller along an upper side of the console on a pivot movement about the vertical axis of the holding element and with the console unfolded into the assembly position.

5. The crane in accordance with claim 4, wherein the first securing device is arranged at a pivotable part of the console that forms an end piece of the console in the assembly position and is configured such that the folding boom does not come into contact with the first securing device in the transport position supported at the telescopic boom and on the pivoting about a vertical axis, with the upper side of the console facing the folding boom.

6. The crane in accordance with claim 5, wherein the upper side of the console is downwardly chamfered in a region of the first securing device.

7. The crane in accordance with claim 4, wherein the first console part is fixedly connected to the telescopic boom.

8. The crane in accordance with claim 3, wherein the first securing device comprises an arrester element that is rod-shaped and that is configured such that on a sliding from the console differing from a pivot movement about a vertical axis, an arrester hook provided at the folding boom comes into engagement with the arrester element and blocks a further movement of the folding boom.

9. The crane in accordance with claim 8, wherein the arrester element projects from the console at both sides, with two arrester hooks being provided at the folding boom that are arranged such that the two arrester hooks come into engagement with the arrester element on both sides of the console on a sliding of the folding boom from the console, with the arrester element being able to be produced in one part or in multiple parts.

10. The crane in accordance with claim 3, wherein the first securing device comprises at least one arrester hook that is configured such that on a sliding of the folding boom from the console differing from a pivot movement about a vertical axis, an arrester element is arranged at the folding boom.

11. The crane in accordance with claim 10, wherein the arrester element is formed by a corner bar or by a connection strut of the folding boom.

12. The crane in accordance with claim 10, wherein the arrester element is of a rod shape and comes into engagement with the arrester hook and blocks a further movement of the folding boom.

13. The crane in accordance with claim 1, wherein the boom head has fastening means for a connection with corresponding fastening means of the folding boom, with at least one fastening means of the folding boom being able to be joined together by a fastening means of the boom head by pivoting the folding boom about the vertical axis of the holding element, with the folding boom being pivotable about a vertical axis of the joined together and connected fastening means after connecting the joined together fastening means and a release of the connection to the holding element and with the remaining fastening means thereby being able to be joined together.

14. The crane in accordance with claim 1, wherein the folding boom has at least one roller via which the folding boom is seated on the console and rolls off on the console during the pivoting about the vertical axis of the holding element, with the folding boom having an arrester hook or an arrester element that comes into engagement with a corresponding arrester element or arrester hook in a region of the console on a sliding of the folding boom from the console differing from a pivot movement about a vertical axis, such that a further movement of the folding boom is blocked.

15. The crane in accordance with claim 1, wherein the securing arm has an upwardly projecting nose at an end.

* * * * *